US005747926A

United States Patent [19]

Nakamoto et al.

[11] Patent Number: 5,747,926

[45] Date of Patent: May 5, 1998

[54] FERROELECTRIC COLD CATHODE

[75] Inventors: Masayuki Nakamoto, Chigasaki; Hiromichi Ohashi, Yokohama, both of Japan

[73] Assignee: Kabushiki Kaisha Toshiba, Kawasaki, Japan

[21] Appl. No.: 612,577

[22] Filed: Mar. 8, 1996

[30] Foreign Application Priority Data

Mar. 10, 1995 [JP] Japan ..... 7-051608

[51] Int. Cl.[6] ..... H01J 1/62; H01J 1/02; H01J 1/16; H01J 19/10

[52] U.S. Cl. ..... 313/495; 313/309; 313/336; 313/351; 313/497

[58] Field of Search ..... 313/309, 311, 313/336, 346 R, 351, 495–97; 315/169.1, 169.3; 445/50, 51

[56] References Cited

U.S. PATENT DOCUMENTS 5,367,181 11/1994 Yoshida ..... 313/309 X
5,453,661 9/1995 Auciello et al. ..... 313/497 X

OTHER PUBLICATIONS

Ferroelectrics, vol. 100, pp. 1–16, 1989, H. Gundel, et al., "Copious Electron Emission From PLZT Ceramics With a High Zirconium Concentration".

Jpn. J. Appl. Phys., vol. 31, No. 9B, pp. 3098–3101, Sep. 1992, Jun-ichi Asano, et al., "Field-Excited Electron Emission From Ferroelectric Ceramic in Vacuum".

*Primary Examiner*—Sandra L. O'Shea
*Assistant Examiner*—Mach Haynes
*Attorney, Agent, or Firm*—Oblon, Spivak, McClelland, Maier & Neustadt, P.C.

[57] ABSTRACT

A ferroelectric cold cathode comprising a ferroelectric layer formed of a ferroelectric material and provided on its one surface with an emitter which is a projection having a sharp tip portion, a first electrode layer formed on one surface of the ferroelectric layer and having an opening allowing the sharp tip portion of the emitter to be exposed therethrough, and a second electrode layer formed on the other surface of the ferroelectric layer. When a voltage is applied between the first electrode and the second electrode, a dielectric polarization is reversed in the ferroelectric layer, resulting in the emission of electrons from the sharp tip portion of the emitter.

20 Claims, 5 Drawing Sheets

FERROELECTRIC COLD CATHODE

BACKGROUND OF THE INVENTION

1. Field of the Invention

This invention relates to a ferroelectric cold cathode and an electronic device provided with a ferroelectric cold cathode.

2. Description of the Related Art

In recent years, the research and development of a vacuum microelectronic device making use of the electron emission from a cold cathode other than making use of the electron transfer within a solid or the electron emission from a hot cathode has been extensively pursued. Furthermore, studies have been proceeding to apply a vacuum microelectronic device to various devices, such as an ultrahigh speed microwave device, a power device, an electron beam device, a flat panel display device wherein a vacuum microelectronic device is disposed for each pixel, or an environment-hard device.

However, there is a problem in achieving a stable and reliable operation of such a vacuum microelectronic device while securing an effective electron emission or a large current capacity that an ultra-high vacuum ranging from $10^{-12}$ to $10^{-6}$ Torr, preferably $10^{-8}$ Torr or less is required as the word of "vacuum" thereof is suggesting.

Namely, for the realization of industrial or commercial use of a vacuum microelectronic device, a cold cathode is required to be mounted while keeping such a high degree of vacuum. Such a vacuum sealing of the cold cathode is however very difficult in various aspects, for example in the actual manufacturing method, in the treatment of the electronic device, or in the reliability and durability of the electronic device.

The current capacity of electronic device is generally preferred to be made as large as possible in order to make it possible to utilize as much a larger current as possible. However, there is a problem that the lower the vacuum degree (higher in pressure) is, the more prominently the emission current will be deteriorated.

There is known a cold cathode which is capable of emitting electrons under such a low degree of vacuum as mentioned above as suggested by H. Gundel et al (Ferroelectrics. Vol. 100 (1989), 1) wherein a ferroelectric material such as lead zirconate titanate (PZT ceramics) or La-modified lead zirconate titanate (PLZT ceramics) is employed; or as suggested by J. Asano et al (Jpn. J. Appl. Phys. Vol. 131 (1992), 3098) wherein a ferroelectric material such as lead zirconate titanate (PZT ceramics) is employed.

These ferroelectric cold cathodes as suggested in these articles are featured in that stripe-like electrodes 2 are formed on one surface of a PZT ceramic substrate 1 and a back electrode 3 is formed all over the other surface of the PZT ceramic substrate 1 as shown in FIGS. 1A and 1B.

When the ceramic substrate 1 was polarized upward direction by any suitable means, much more electrons or negative ions 5 are caused to generate in order to compensate the polarization on one side of the PZT ceramic substrate 1 where the stripe-like electrodes 2 are formed, as compared with any other portions of the PZT ceramic substrate 1 as shown in FIG. 1A.

When a sufficient magnitude of voltage is applied on the back electrode 3 as shown in FIG. 1B, the polarization is suddenly inverted thereby emitting electrons 4 or negative ions from the exposed portions of the PZT ceramic substrate 1.

The precise mechanism of the emitting of electrons 4 is not clear as yet, but the mechanism may be explained by the following reasoning. Namely, when the polarization is inverted, a very strong electric field is caused to generate at or near the stripe-like electrodes 2 so that the stripe-like electrodes 2 and vicinity thereof are exposed to this strong electric field. As a result, due to the attraction force by this strong electric field and the repulsive force between negative charges by the inversion of the polarization, the electrons in the ferroelectric material and the negative ions which have been adhered onto the surface of the ferroelectric material are forced to emit into vacuum space.

This electron emission phenomenon can also be seen under a vacuum degree of as low as $10^{-2}$ to $10^{-1}$ Torr where other cold cathodes can not emit electrons hence attracting many attentions. Moreover, it is possible with the employment of a cold cathode to obtain a high current density of as high as several A/cm$^2$ to 100 A/cm$^2$ so that the cold cathode is expected to be applicable to many fields.

However, the conventional ferroelectric cold cathodes are accompanied with the following serious defects.

First, a voltage of as high as several kV is required, even with the employment of the aforementioned technique suggested by Gundel et al, to cause the inversion of polarization for inducing an electron emission.

According to the aforementioned technique suggested by Asano et al, the PZT ceramic plate 1 is made as thin as 30 to 60 μm through polishing in order to facilitate the inversion of polarization, the resultant cold cathode still requiring a high voltage as high as 75 to 150V is required for the inversion of polarization. Therefore, it is impossible to apply the technique suggested by Asano et al to the actual production of a device which can be driven with such a low voltage as will be obtainable from a dry battery.

Moreover, it is certainly possible to facilitate the inversion of polarization itself by thinning the PZT ceramic substrate 1, but it will raise another more serious problem that an induction electric field required for the emission of electrons will be deteriorated.

Further, if a ceramic material such as the PZT ceramic substrate 1 is thinned through polishing down to 30 to 50 μm in thickness, the physical strength thereof becomes extremely fragile in general so that it may be cracked easily during the manufacture or handling of the device, thus raising problems of difficulty in manufacturing or handling the device.

Due to these various problems, the technique of thinning a fragile ferroelectric material such as the PZT ceramic substrate 1 itself for realizing a low voltage drive of a device is now already confronted with limitations, so that it has been considered no more possible to further proceed with the development of the low voltage drive of the device. Namely, these problems have been a serious obstacle to the realization of a ferroelectric cold cathode.

SUMMARY OF THE INVENTION

Accordingly, an object of the present invention is to provide a ferroelectric cold cathode which can be driven with high stability and reliability even in a low degree of vacuum without requiring the thinning of a ferroelectric layer.

Another object of this invention is to provide an electronic device provided with the aforementioned ferroelectric cold cathode.

Another object of this invention is to provide a method of manufacturing the aforementioned ferroelectric cold cathode.

Namely, according to the present invention, there is provided a ferroelectric cold cathode comprising a ferroelectric layer formed of a ferroelectric material and provided on its one surface with an emitter which is a projection having a sharp tip portion; a first electrode layer formed on said one surface of the ferroelectric layer and having an opening allowing said sharp tip portion of the emitter to be exposed therethrough; and a second electrode layer formed on the other surface of the ferroelectric layer.

According to the present invention, there is further provided a ferroelectric cold cathode comprising a ferroelectric layer formed of a ferroelectric material and provided on its one surface with an emitter which is a projection having a sharp tip portion; a first electrode layer formed on said one surface of the ferroelectric layer and having an opening allowing said sharp tip portion of the emitter to be exposed therethrough; a first insulating film formed on said first electrode layer and having an opening allowing said sharp tip portion of the emitter to be exposed therethough; an auxiliary electrode formed on said first insulating film and having an opening allowing said sharp tip portion of the emitter to be exposed therethough; and a second electrode layer formed on the other surface of the ferroelectric layer.

Further, according to the present invention, there is also provided an electronic device comprising a ferroelectric cold cathode and an anode disposed to face to said ferroelectric cold cathode; said ferroelectric cold cathode comprising a ferroelectric layer formed of a ferroelectric material and provided on its one surface with an emitter which is a projection having a sharp tip portion; a first electrode layer formed on said one surface of the ferroelectric layer and having an opening allowing said sharp tip portion of the emitter to be exposed therethrough; a second electrode layer formed on the other surface of the ferroelectric layer; and a voltage-applying means adapted to apply a voltage between said first electrode and said second electrode thereby to reverse a dielectric polarization in said ferroelectric layer and thereby allowing electrons to be emitted from the sharp tip portion of said emitter and then to reach to said anode.

Moreover, according to the present invention, there is further provided a method of manufacturing a ferroelectric cold cathode which comprises the steps of;

forming a depression in a substrate; depositing a ferroelectric material over a surface of the substrate including said depression thereby forming a ferroelectric layer; removing said substrate to expose said ferroelectric material deposited in said depression thereby to form an emitter which is a projection having a sharp tip portion; forming a first electrode layer on one surface of said ferroelectric layer where said emitter is disposed in such a manner as to allow said sharp tip portion of the emitter to be exposed therethrough; and forming a second electrode layer on the other surface of said ferroelectric layer which is opposite to said one surface where said emitter is disposed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1A:
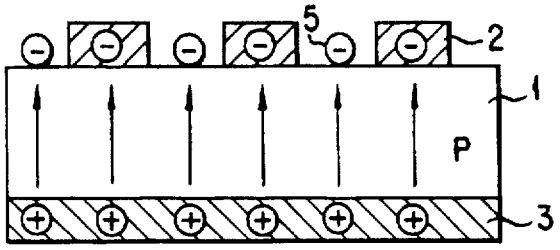
FIG. 1A (PRIOR ART)
FIGS. 1A and 1B are sectional views showing one embodiment of an electronic device provided with a conventional ferroelectric cold cathode.
Figure 1B:
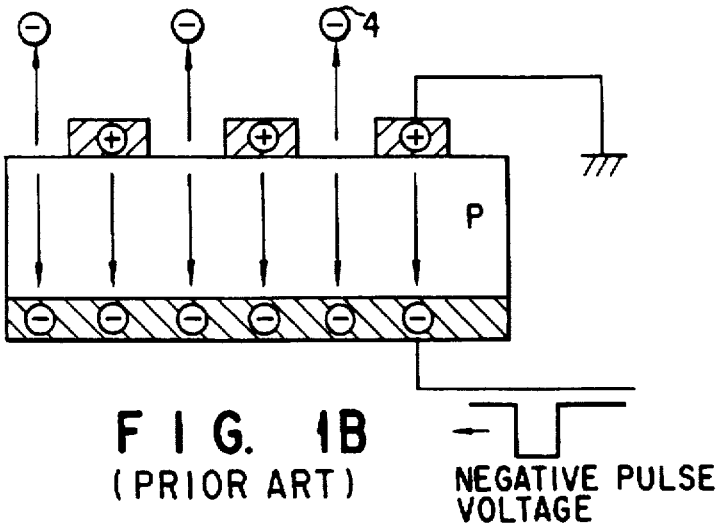
FIG. 1B (PRIOR ART)

A ferroelectric cold cathode according to this invention comprises a ferroelectric layer formed of a ferroelectric material and provided on its one surface with an emitter of a projected structure having a sharp tip portion, a first electrode layer formed on the one surface of the ferroelectric layer and having an opening allowing the sharp tip portion of the emitter to be exposed therethrough, a second electrode layer formed on the other surface of the ferroelectric layer, and a voltage-applying means adapted to apply a voltage between the first electrode and the second electrode thereby to generate a dielectric polarization in the ferroelectric layer.

The projected structure constituting an emitter of this invention is provided with a sharp tip portion, and the radius of curvature of the tip portion should preferably be 0.5 to 500 nm, more preferably 1 to 200 nm. If the radius of curvature of the tip portion is less than 0.5 nm, the size of the polarization domain becomes too small, and the tip portion becomes brittle due to strain caused by reversion of the polarization, while if the radius of curvature of the tip portion exceeds over 500 nm, it would be difficult to attain the effect of this invention.

The thickness of the ferroelectric layer should preferably be at least 0.02 μm, more preferably at least 0.1 μm. If the thickness of the ferroelectric layer is less than 0.02 μm, film formation of the ferroelectric layer may become difficult.

There is any particular restriction as to the height of the projected structure, but generally the height may be in the range of 0.1 to 100 μm.

There is any particular restriction as to the shape of the projected structure, so that the shape may be pyramid-like or cone-like. Further, the projected structure may not be a single structure, but may be a continuous structure such as a ridge-like structure.

With respect to the size of the sharp tip portion to be exposed as mentioned above, there is any particular limitation, but the size may be 0.04 to 10 μm in general.

As for the materials to be employed for the ferroelectric material in this invention, $PbZrO_3$—$PbTiO_3$ system material (PZT), (Pb, La)(Zr, Ti)$O_3$ system material (PLZT), $PbTiO_3$ system material, (Pb, Ca)$TiO_3$ system material, pb($Mg_{1/3}Nb_{2/3}$)$O_3$—$PbZrO_3$—$PbTiO_3$ system material, $LaTiO_3$, $LiNbO_3$, and $SrTiO_3$ system material etc.

With respect to the first electrode layer formed on the one surface of the ferroelectric layer and having an opening allowing the sharp tip portion of the emitter to be exposed therethrough, a metal such as W, Cr, Mo, Ta, Ni, Al, and Au, or a semiconductor such as Si, which is doped with impurities may be employed. The thickness of this first electrode layer may preferably be 0.1 to 100 μm.

With respect to the second electrode layer formed on the other surface of the ferroelectric layer, a transparent conductive material such as ITO, and a metal such as Mo, Ta, Ni, Al, W, Cr and Au may be employed.

The ferroelectric cold cathode constituted by the aforementioned structure can be formed on a substrate such as a glass substrate. Namely, the substrate and the second electrode can be adhered to each other.

An insulating layer formed of $SiO_2$ or SiN may be interposed between the ferroelectric layer and the first electrode layer. Materials suited for this insulating layer are $SiO_2$ which is formed through a thermal oxidation for the purpose of sharpening of the tip portion of the cold cathode.

An auxiliary electrode layer may be formed on the first electrode layer with the insulating layer being interposed therebetween. An opening is also formed in this auxiliary electrode layer in such a manner as to expose the tip portion of the emitter as in the case of the first electrode layer. This auxiliary electrode layer functions to control the electric field in the vicinity of the tip portion of the emitter thereby to facilitate the emission of electrons.

The material and opening size of this auxiliary electrode layer may be the same as those of the first electrode layer. In particular, the size of the opening can be determined in consideration of emitting direction of electron beams and operation voltage.

The ferroelectric cold cathode of this invention as explained above is applicable to various kinds of electronic device. For example, a plurality of emitters may be set in array on a flat surface, and an anode may be disposed to face the array of the emitters, whereby forming an electronic device.

In particular, by disposing this emitter at each pixel, and at the same time by interposing a fluorescent substance between the ferroelectric cold cathode and the anode, a display device can be constructed. In this case, the electrons emitted from the ferroelectric cold cathode move toward the anode and impinged upon the fluorescent substance, thus emitting a light for displaying a prescribed image.

The ferroelectric cold cathode of this invention can be manufactured by the following methods.

(1) A method comprising the steps of forming a depression in a substrate formed of Si monocrystal for example; depositing a ferroelectric material over a surface of the Si monocrystalline substrate including the depression; and then removing the Si monocrystalline substrate by means of etching for example.

(2) A method comprising the steps of molding a ferroelectric composition containing a binder in a mold provided with a depression; and sintering the molded product.

(3) A method comprising the steps of molding and sintering a ferroelectric composition containing a binder in a mold provided with a depression by means of a hot press.

(4) A method comprising the steps of molding and sintering a ferroelectric composition containing a binder in a mold provided with a depression by means of a hydrostatic hot press.

According to the ferroelectric cold cathode of this invention as explained above, it is possible to concentrate an electric field induced by the reversion of polarization at the emitter and the circumference around the opening of the first electrode layer disposed near the emitter, thus enabling to form an extremely strong electric field around the emitter as compared with the conventional cold cathode. As a result, the emission efficiency of electron or negative ion can be extremely improved to realize a low voltage operation of the cold cathode.

When an electronic device is formed with a large number of such electron-emitting emitters as explained above and the first electrodes by setting them in array, the electronic device can be operated at a low degree of vacuum and at a large electric current and low voltage. Namely, according to this invention, it is possible to operate an electronic device at a vacuum degree of as low as $10^{-2}$ to $10^{-1}$ Torr and with an electric current of as large as about 100 A/cm$^2$ and of low voltage of 7 to 30V.

Moreover, even if a ferroelectric material is thinned for facilitating the reversion of polarization, any deterioration resulting from the thinning of the ferroelectric material can be sufficiently compensated by the effect of the concentration of electric field as mentioned above.

It is no more required to thin the ferroelectric material through polishing, i.e., the ferroelectric film can be formed through deposition. The ferroelectric film formed through deposition has a suitable degree of flexibility in general and is formed on a substrate, thus making it possible to eliminate the problems associated with the conventional method, such as a difficulty in thinning and handling a ferroelectric material.

As explained above, it is possible according to this invention to provide a ferroelectric cold cathode which can be operated at a low degree of vacuum and can be easily manufactured and handled. Moreover, the ferroelectric cold cathode that can be obtained by this invention is excellent in reliability and suited for use in a low voltage operation and for realizing a device of a large electric current capacity. This invention further provides an electronic device provided with such a ferroelectric cold cathode as explained above.

This invention will be explained further with reference to drawings illustrating a ferroelectric cold cathode of this invention, an electronic device provided with a ferroelectric cold cathode of this invention and the methods of manufacturing them.

EXAMPLE 1

Figure 2:
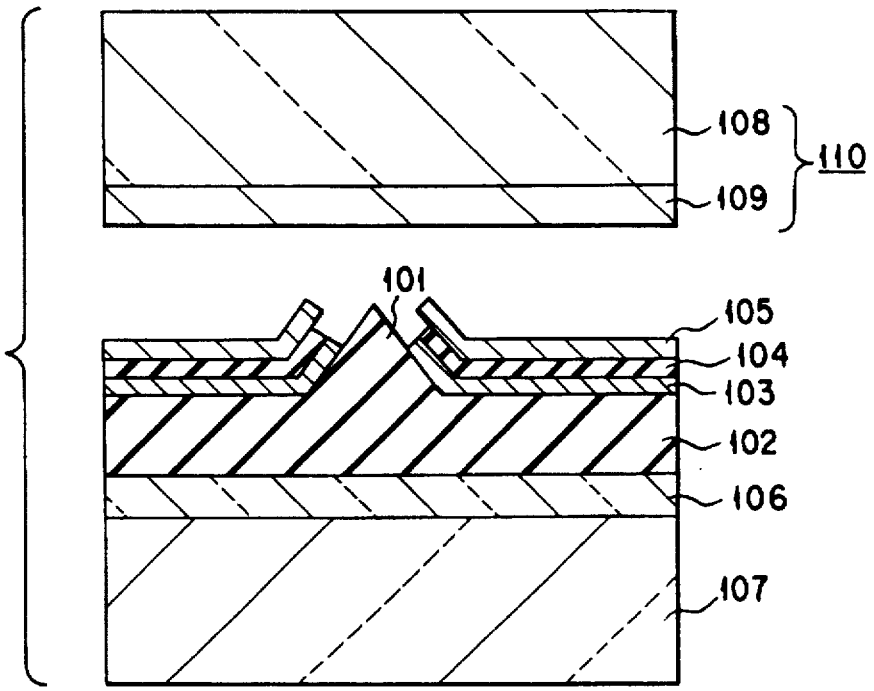
FIG. 2 is a sectional view schematically showing the structure of an electronic device provided with a ferroelectric cold cathode according to a first example of this invention.

FIG. 2 schematically illustrates the structure of a ferroelectric cold cathode according to a first example of this invention.

Referring to FIG. 2, a ferroelectric layer 102 is formed of a ferroelectric material and provided on its surface with an emitter 101 having a sharp tip portion projected therefrom for effecting the emission of electrons. On this ferroelectric layer 102 is formed an electrode layer 103 for applying a voltage onto the ferroelectric layer 102, the electrode layer 103 being provided with an opening permitting at least the sharp tip portion of the emitter 101 to be exposed therefrom. Further, an insulating layer is formed to cover the upper surface of the electrode layer 103, the insulating layer 104 also being provided with an opening permitting at least the sharp tip portion of the emitter 101 to be exposed therefrom.

Further, an auxiliary electrode layer 105 having an opening is formed on the insulating layer in such a manner that at least the tip portion of the emitter 101 is exposed form the opening. The periphery of the opening of the auxiliary electrode layer 105 is spaced apart from the projected tip portion of the emitter 101 so as to allow a potential difference to be generated between them and thereby to control the electric field around the emitter 101.

A back electrode layer 106 is formed on the other surface of the ferroelectric layer 102, i.e. a surface which is opposite to the surface where the electrode layer 103 is formed. A voltage which is different from the voltage to be applied onto the electrode layer 103 is applied to this back electrode layer 106, thus generating a potential difference between these voltages thereby to reverse a dielectric polarization in the ferroelectric layer 102.

To the back main surface (as seen in FIG. 2) of the back electrode layer 106, there is attached a glass substrate 107 as a supporting substrate so that the whole structural components including the ferroelectric layer 102 are physically supported by this glass plate 107.

An anode 110 is disposed to face to the emitter 101 of the ferroelectric cold cathode explained above. This anode 110 is constituted by an anode-supporting substrate 108 and an anode 109 formed on the anode-supporting substrate 108.

The manufacturing method of the ferroelectric cold cathode having the aforementioned structure according to the first example of this invention will be explained below together with the explanation on the materials employed therein.

FIGS. 3A to 3G illustrate a manufacturing process, in the order of manufacturing steps, of the ferroelectric cold cathode according to the first example of this invention.

First, a V-shaped depression 202 having a sharp tip bottom is formed on the one main surface (the upper main surface in FIG. 3A) of a monocrystalline substrate 201. This V-shaped depression 202 may be formed by an anisotropic etching of a Si-monocrystalline substrate as explained below.

Namely, a $SiO_2$ thermal oxidation layer (not shown) 0.1 μm in thickness is formed via a dry oxidation method on a p-type Si-monocrystalline substrate 201 having (100) crystal face orientation, and then a resist (not shown) is coated on this thermal oxidation layer by means of spin coating. Subsequently, the resist layer is exposed through a stepper and developed to form a resist pattern having for example a square opening (0.8 μm×0.8 μm). Then, the $SiO_2$ thermal oxidation layer is etched using a $NH_4F$/HF mixed solution with the resist pattern being used as a mask.

Figure 3A:
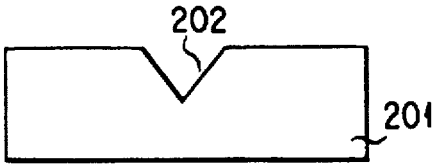
FIGS. 3A to 3G are sectional views illustrating a manufacturing process of the electronic device shown in FIG. 2.

Thereafter, the resist pattern is removed, and an anisotropic etching using a 30 wt % aqueous solution of KOH is performed to form a reverse pyramid-shaped depression 202 having a depth of 0.56 μm is formed on the Si-monocrystalline substrate 201 as shown in FIG. 3A.

Figure 3B:
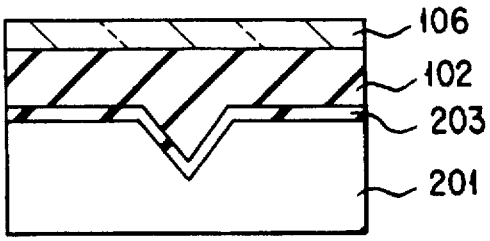

Then, after the $SiO_2$ thermal oxidation layer is once removed by using a $NH_4F$/HF mixed solution, a fresh $SiO_2$ thermal oxidation layer 203 is formed all over the Si-monocrystalline substrate 201 including the inner surface of the depression 202 as shown in FIG. 3B.

In this example, the $SiO_2$ thermal oxidation layer 203 is formed via a dry oxidation method so as to control the thickness of the $SiO_2$ thermal oxidation layer 203 to 0.2 μm. At this occasion, the thermal oxidation on the inner surface of the depression 202 is also proceeded, the distal end (bottom) of the depression 202 can be made more sharpened as compared with the original shape of the depression 202. In this respect, the employment of a thermal oxidation method as employed in this example is preferred. However, if there is no requirement to sharpen to this extent or the tip of the emitter is not etched by an etching solution in the step of removing an Si substrate as described later, the thermal oxidation of the inner surface of the depression 202 may not be performed, but left in the state of original shape obtained from the etching.

Then, as shown in FIG. 3B, a ferroelectric material such as $PbZrO_3$—$PbTiO_3$ system material (PZT), (Pb, La)(Zr, Ti)$O_3$ system material (PLZT), $PbTiO_3$ system material, (Pb, Ca)$TiO_3$ system material, $Pb(Mg_{1/3}Nb_{2/3})O_3$—$PbZrO_3$—$PbTiO_3$ system material, $LaTiO_3$, $LiNbO_3$, and $SrTiO_3$ system material etc. is deposited on the $SiO_2$ thermal oxidation layer 203 to form an emitter 101 and a ferroelectric layer 102 provided on its surface with the emitter 101. In this example, the thickness of ferroelectric layer 102 is controlled to 0.8 μm by using a sputtering method.

Subsequently, a conductive material such as ITO (indium tin oxide), Mo, Ta, Cr, Ni, Al and Au is deposited on the surface of the ferroelectric layer 102 to form a 1 μm thick film thereby forming a back electrode 106. In this case, the back electrode 106 may be omitted depending on the material of a structural substrate 107. Namely, if the conductivity of the structural substrate 107 itself is sufficient enough to be used as a back electrode, the back electrode 106 may be omitted.

Figure 3C:
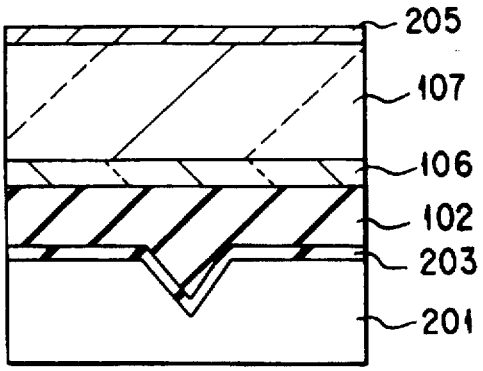

Meanwhile, as a supporting substrate, a glass substrate 107 having a thickness of 1 mm and formed of a pyrex glass coated on its back surface with a 0.4 μm thick Al layer 205 is prepared. Then, as shown in FIG. 3C, the glass substrate 107 is adhered onto the conductive layer 106 formed on the surface of the Si-monocrystalline substrate 201. This adhering may be performed by using for example an electrostatic adhering method. This electrostatic adhering method can be performed by impressing an electric voltage to the Al layer 205. This electrostatic adhering method is considered to be preferable in view of weight-saving or thinning a cold cathode device to be obtained.

Figure 3D:
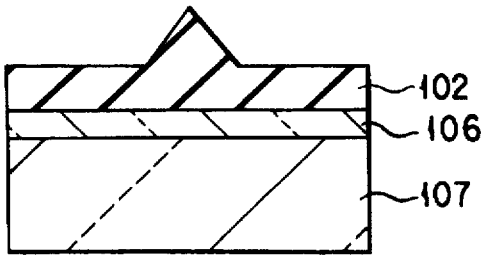

Then, as shown in FIG. 3D, the Al layer 205 on the back surface of the glass substrate 107 is removed with a mixed acid solution comprising nitric acid ($HNO_3$), acetic acid ($CH_3COOH$) and hydrofluoric (HF). Subsequently, the Si-monocrystalline substrate 201 and the $SiO_2$ thermal oxidation layer 203 are selectively etched off with an aqueous solution containing ethylene diamine, pyrocatechol and pyrazine (ethylene diamine:pyrocatechol:pyrazine:water=75 cc:12 g:3 mg:10 cc) and thereafter with a mixed solution of $NH_4$ and HF, whereby exposing the ferroelectric layer 102 bearing the emitter 101 having a sharp pyramidal tip portion.

It should be noted that FIG. 3D is depicted turning those shown in FIGS. 3A to 3C upside-down so as to direct the distal tip of the emitter upward for the convenience of intuitional understanding. In the actual process of the device, this upside-down technique is adopted for the convenience of treatment.

As explained above, the emitter 101 is formed by utilizing the depression 202 of the Si-monocrystalline substrate 201 as a mold and by filling the depression 202 with a ferroelectric material.

Figure 3E:
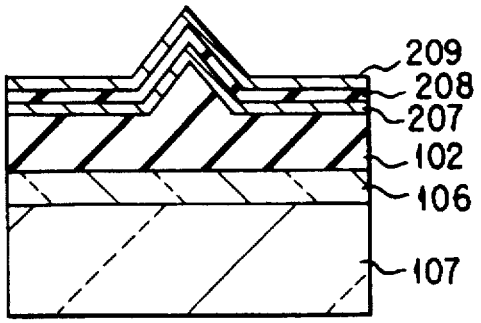

Subsequently, a conductive film 207 consisting of a good conductive metal such as W, Cr, Mo, Ta, Ni and Al, or Si which is made conductive by the addition of impurity dopants, is formed on the ferroelectric layer 102 as shown in FIG. 3E. This conductive film 207 is subsequently turned into an electrode layer 103 for applying a voltage to the ferroelectric layer 102 to generate a dielectric polarization. Then, an insulating film 208 such as SiO2 thermal oxidation film if formed on the upper surface of the conductive film 207 to cover the upper surface of the conductive film 207. This insulating film 208 is ultimately turned into an insulating film 104.

Then, another conductive film 209 consisting of a highly conductive metal such as tungsten (W), chromium (Cr), Mo, Ni, Ta and Al or Si which is made conductive by the addition of impurity dopants, is formed on the insulating film 208. This conductive film 209 is subsequently turned into an auxiliary electrode layer 105 for controlling the electric field around the emitter.

Figure 3F:
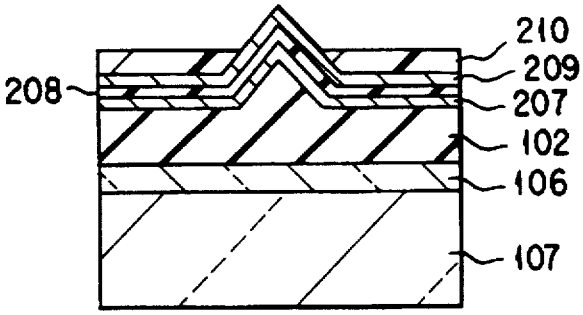

Thereafter, as shown in FIG. 3F, a resist 210 is coated on the surface of the conductive film 209 and then the resist 210 thus coated is patterned via an dry etching by means of oxygen plasma for example to form an opening of a size which allows the tip portion of the emitter 101 of pyramidal shape (FIG. 2) to expose at a height of about 0.4 μm. Specific size of the opening or the exposed tip portion of the emitter 101 may be suitably determined depending on the current capacity desired of the ferroelectric cold cathode.

Figure 3G:
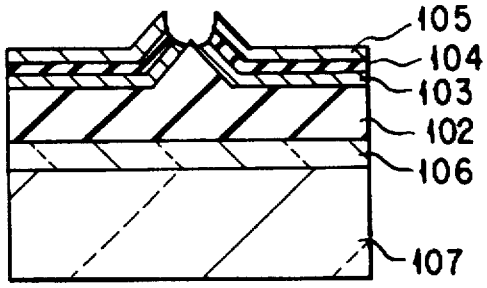

Then, portions of the conductive film 207, insulating film 208 and conductive film 209 which are exposed from the resist 210 are etched off by means of for example a reactive ion etching thereby forming an opening in each of the conductive film 207, insulating film 208 and conductive film 209, whereby exposing the tip portion of the emitter 101 as shown in FIG. 3G. After the completion of the etching process, any residual portion of the resist 210 which becomes useless is stripped off (removed) to form the electrode layer 103, insulating layer 104 and auxiliary electrode layer 105 respectively.

Finally, an anode 109 is disposed in such a manner that the anode 107 faces to and spaced apart from the emitter 101.

As a result, the main portion of the ferroelectric cold cathode according to the first example of this invention can be manufactured.

EXAMPLE 2

Figure 4:
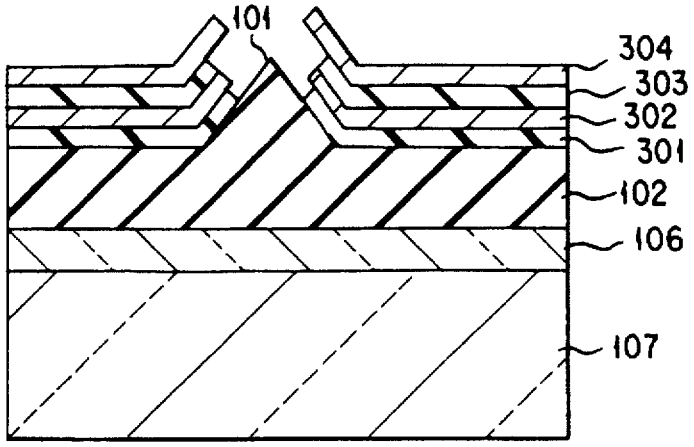
FIG. 4 is a sectional view schematically showing the structure of an electronic device provided with a ferroelectric cold cathode according to a second example of this invention.

FIG. 4 schematically illustrates the structure of a ferroelectric cold cathode according to a second example of this invention.

Referring to FIG. 4, a ferroelectric layer 102 is formed of a ferroelectric material and provided on its surface with an emitter 101 having a sharp tip portion projected therefrom for effecting the emission of electrons. On this ferroelectric layer 102 is formed a first insulating layer 301, the first insulating layer 301 being provided with an opening permitting at least the sharp tip portion of the emitter 101 to be exposed therefrom. Further, an electrode layer 302 is formed to cover the upper surface of the first insulating layer 301, the electrode layer 302 also being provided with an opening permitting at least the sharp tip portion of the emitter 101 to be exposed therefrom.

The electrode layer 302 functions to apply a voltage onto the ferroelectric layer 102.

Further, a second insulating layer 303 having an opening is formed on the electrode layer 302 in such a manner that at least the tip portion of the emitter 101 is exposed form the opening. An anode layer 304 for receiving electrons emitted from the emitter 101 is formed on the second insulating layer 303 in such a manner that the anode layer 304 is spaced apart from the emitter 101.

A back electrode layer 106 is formed on the other surface of the ferroelectric layer 102, i.e. a surface which is opposite to the surface where the electrode layer 103 is formed. A voltage which is different from the voltage to be impressed onto the electrode layer 103 is to be applied to this back electrode layer 106, thus generating a potential difference between these voltages thereby to reverse a dielectric polarization in the ferroelectric layer 102.

To the back main surface (as seen in FIG. 4) of the back electrode layer 106, there is attached a glass substrate 107 as a supporting substrate so that the whole structural components including the ferroelectric layer 102 are physically supported by this glass plate 107.

The first insulating layer 301 employed in this example may be omitted depending on the film thickness of the ferroelectric layer 102 or on the current capacity or accuracy demanded of the cold cathode.

The manufacturing method of the ferroelectric cold cathode having the aforementioned structure according to the second example of this invention will be explained below together with the explanation on the materials employed therein.

FIGS. 5A to 5H illustrate a manufacturing process, in the order of manufacturing steps, of an electronic device provided with the ferroelectric cold cathode according to the second example of this invention.

First, a V-shaped depression 202 having a sharp tip bottom is formed on the one main surface (the upper main surface in FIG. 5A) of a monocrystalline substrate 201. This V-shaped depression 202 may be formed by an anisotropic etching of a Si-monocrystalline substrate as explained in the first example.

Figure 5A:
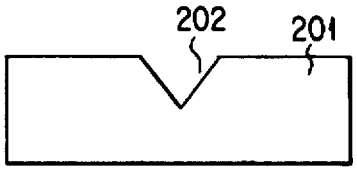
FIGS. 5A to 5H are sectional views illustrating a manufacturing process of the electronic device shown in FIG. 4.
Figure 5D:
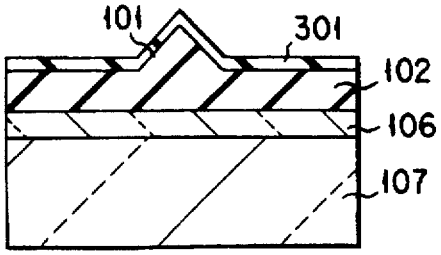

Namely, by means of an anisotropic etching, a reverse pyramid-shaped depression 202 having a depth of 0.56 μm is formed on the Si-monocrystalline substrate 201 as shown in FIG. 5A.

Figure 5B:
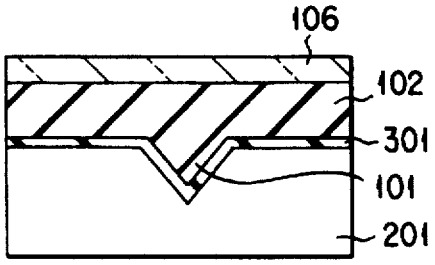

Then, after the $SiO_2$ thermal oxidation layer is once removed by using a $NH_4F/HF$ mixed solution, a fresh $SiO_2$ thermal oxidation layer 301 is formed all over the Si-monocrystalline substrate 201 including the inner surface of the depression 202 as shown in FIG. 5B.

In this example, the $SiO_2$ thermal oxidation layer 301 is formed via a dry oxidation method so as to control the thickness of the $SiO_2$ thermal oxidation layer 203 to 0.2 μm. It is also possible to deposit $SiO_2$ by means of a CVD method. However, a $SiO_2$ film to be formed via a thermal oxidation is excellent in density and easy to control, and also the thermal oxidation will be proceeded on the inner surface of the depression 202, so that the distal end (bottom) of the depression 202 can be made more sharpened as compared with the original shape of the depression 202. In view of these advantages, the employment of a thermal oxidation method as employed is preferred.

Then, as shown in FIG. 5B, a ferroelectric material such as explained in the first example is deposited on the $SiO_2$ thermal oxidation layer 301 to form an emitter 101 and a flat ferroelectric layer 102 provided on its surface with the emitter 101. In this example, the thickness of ferroelectric layer 102 is controlled to 0.8 μm by using a sputtering method.

Subsequently, a conductive material such as Mo, Ta, Cr, Ni, Au and Al is deposited on the surface of the ferroelectric layer 102 to form a 1 μm thick film thereby forming a back electrode 106. In this case, the back electrode 106 may be omitted depending on the material of the supporting substrate 107 described later. Namely, if the conductivity of the supporting substrate 107 itself is sufficient enough to be used as a back electrode, the back electrode 106 may be omitted.

Meanwhile, as a supporting substrate, a glass substrate 107 having a thickness of 1 mm and formed of a pyrex glass coated on its back surface with a 0.4 μm thick Al layer 205 is prepared. Then, as shown in FIG. 5C, the glass substrate 107 is adhered onto the conductive layer 106 formed on the surface of the Si-monocrystalline substrate 201. This adhering may be performed by using for example an electrostatic adhering method. This electrostatic adhering method can be performed by applying an electric voltage to the Al layer 205. This electrostatic adhering method is considered to be preferable in view of weight-saving or thinning a cold cathode device.

Then, as shown in FIG. SD, the Al layer 205 on the back surface of the glass substrate 107 is removed with a mixed acid solution comprising nitric acid ($HNO_3$), acetic acid ($CH_3COOH$) and hydrofluoric (HF). Subsequently, the Si-monocrystalline substrate 201 is selectively etched off with an aqueous solution comprising ethylene diamine, pyrocatechol and pyrazine (ethylene diamine:pyrocatechol:pyrazine:water=75 cc:12 g:3 mg:10 cc), whereby exposing the ferroelectric layer 102 bearing the emitter 101 having a sharp pyramidal tip portion covered with the thermal oxide layer 301.

As explained above, the emitter 101 is formed by utilizing the depression 202 of the Si-monocrystalline substrate 201 as a mold die and by filling the depression 202 with a ferroelectric material.

Figure 5E:
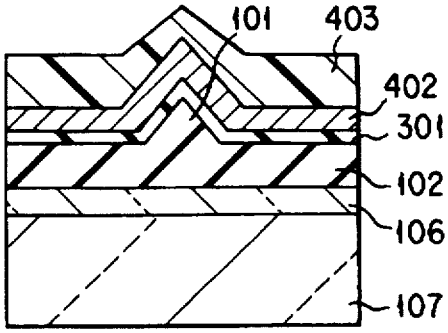
Figure 5C:
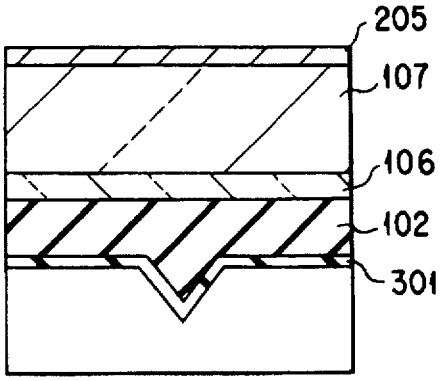

Subsequently, a conductive film 402 consisting of a good conductive metal such as tungsten (W), chromium (Cr), Mo, Ta, Ni, Al, and Au etc. or Si which is made conductive by the addition of impurity dopants is formed on the $SiO_2$ thermal oxidation insulating layer 301 as shown in FIG. 5E. This conductive film 402 subsequently functions as an electrode layer 302 for applying a voltage to the ferroelectric layer 102 to reverse a dielectric polarization.

Figure 5F:
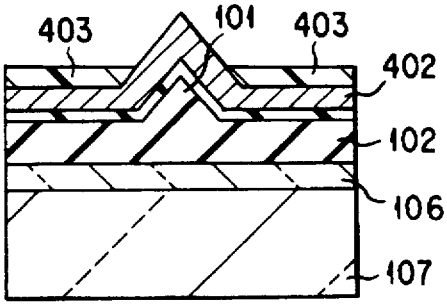

Thereafter, as shown in FIG. 5F, a resist 403 is coated on the surface of the conductive film 402 and then the resist 403 thus coated is patterned via an dry etching by means of oxygen plasma for example to form an opening of a size which allows the tip portion of the emitter 101 of pyramidal shape (FIG. 4) to expose at a height of about 0.4 μm.

Figure 5G:
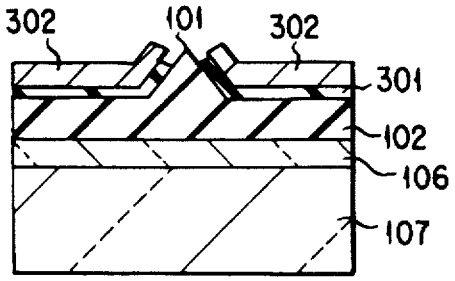

Then, portions of the conductive film 401 and insulating film 301 which are exposed from the resist 403 are etched off by means of for example a reactive ion etching thereby forming an opening in each of the conductive film 401 and the insulating film 301, whereby exposing the tip portion of the emitter 101 as shown in FIG. 5G. After the completion of the etching process, any residual portion of the resist 403 which becomes useless is stripped off (removed).

Then, PSG (phosphosilicate glass) 303 is formed as an interlayer insulating film on all over the upper surface of the device, and a conductive film 304 to be functioned as an anode layer is further formed on the PSG 303. Then, a portion of the PSG 303 covering the tip portion of the emitter 101 which is required to be exposed for the emission of electrons is removed through dissolution together with a portion of the conductive film 304 disposed on the aforementioned portion of the PSG 303, thereby forming an opening. The partial removal through dissolution of the PSG 303 layer can be performed via a small hole which has been formed in advance in the conductive film 304.

Figure 5H:
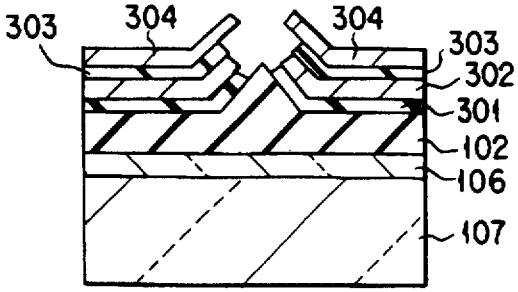

As a result, an electronic device provided with a ferroelectric cold cathode comprising an emitter 101 having an exposed tip portion and an anode layer 304 disposed near the tip portion of the emitter 101 with a space being kept therebetween as shown in FIG. 5H can be obtained.

As explained above, it is possible to easily fabricate a structure wherein the anode layer 304 is disposed to face the tip portion of the emitter 101 with a space being kept therebetween, so that the distribution of electric field can be modified in such a manner that the ratio of current flowing toward the anode is extremely increased as compared with the current flowing toward the gate electrode.

Therefore, it is possible according to the ferroelectric cold cathode of this example as well as the electronic device employing such a ferroelectric cold cathode to greatly improve the electron emission efficiency and the uniformity of the electron emission.

The structure of this second example where the anode layer 304 is disposed on the electrode layer 302 with the insulating interlayer 303 being interposed therebetween can be applied to the electronic device of the first example. Namely, instead of disposing the anode 109 to face the emitter 101 in separate from the ferroelectric cold cathode, an anode layer may be disposed on the auxiliary electrode 105 with an insulating interlayer being disposed therebetween.

Alternatively, instead of employing the anode layer 304, an anode may be disposed to face the emitter 101 in separate from the ferroelectric cold cathode in the second example.

Incidentally, the insulating layer 301 may be omitted in the second example.

EXAMPLE 3

Figure 6:
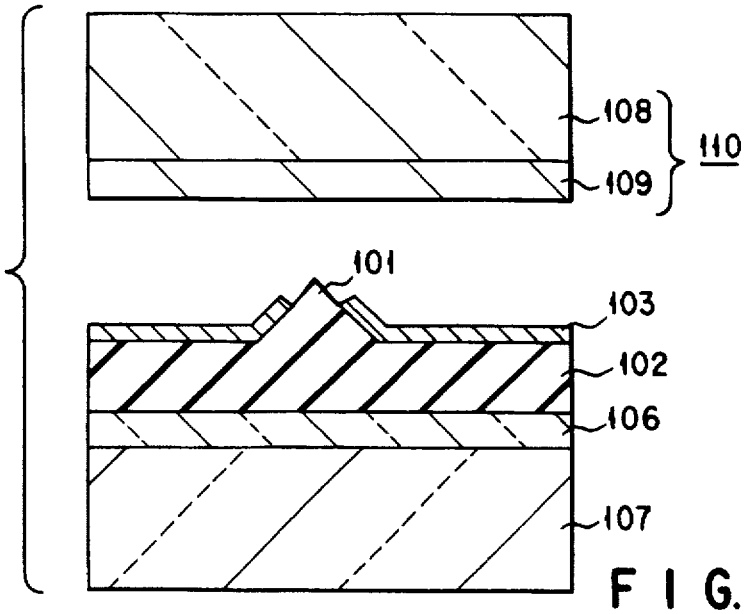
FIG. 6 is a sectional view schematically showing the structure of an electronic device provided with a ferroelectric cold cathode according to a third example of this invention.

FIG. 6 schematically illustrates the structure of a ferroelectric cold cathode according to a third example of this invention.

Referring to FIG. 6, a ferroelectric layer 102 is formed of a ferroelectric material and provided on its surface with an emitter 101 having a sharp tip portion projected therefrom for effecting the emission of electrons. On this ferroelectric layer 102 is formed an electrode layer 103 which is adapted to apply a voltage onto the ferroelectric layer 102 and at the same time to generate an electric field between the electrode layer 103 and the emitter 101, the electrode layer 103 being provided with an opening permitting at least the sharp tip portion of the emitter 101 to be exposed therefrom.

A back electrode layer 106 is formed on the other surface of the ferroelectric layer 102, i.e. a surface which is opposite to the surface where the electrode layer 103 is formed. A voltage which is different from the voltage to be applied onto the electrode layer 103 is to be applied to this back electrode layer 106, thus generating a potential difference between these voltages thereby to reverse a dielectric polarization in the ferroelectric layer 102.

To the back main surface (as seen in FIG. 6) of the back electrode layer 106, there is attached a glass substrate 107 as a supporting substrate so that the whole structural components including the ferroelectric layer 102 are physically supported by this glass plate 107.

An anode 110 is disposed to face the emitter 101 of the aforementioned ferroelectric cold cathode. This anode 110 comprises a plate-like anode-supporting substrate 108 and an anode 109 formed on the anode-supporting substrate 108.

Since the ferroelectric cold cathode of the electronic device explained above is constructed such that the electrode layer 103 is disposed directly on the ferroelectric layer 102, and the auxiliary electrode layer 105 is omitted, the structure can be more simplified as compared with those of the first and second examples, and the manufacturing method thereof can be also simplified.

The ferroelectric cold cathode of the third example can be easily manufactured in accordance with the methods explained in reference to the first and second examples.

In the above examples, a glass substrate 107 is employed as a supporting substrate to be adhered onto the back surface of the device. However, other materials such as a glass-epoxy substrate provided thereon with a printed circuit, a metallic substrate may be also employed as a supporting substrate. Alternatively, such a supporting substrate may be omitted if the physical (mechanical) strength of the ferroelectric layer 102 is sufficiently large enough.

EXAMPLE 4

Figure 7A:
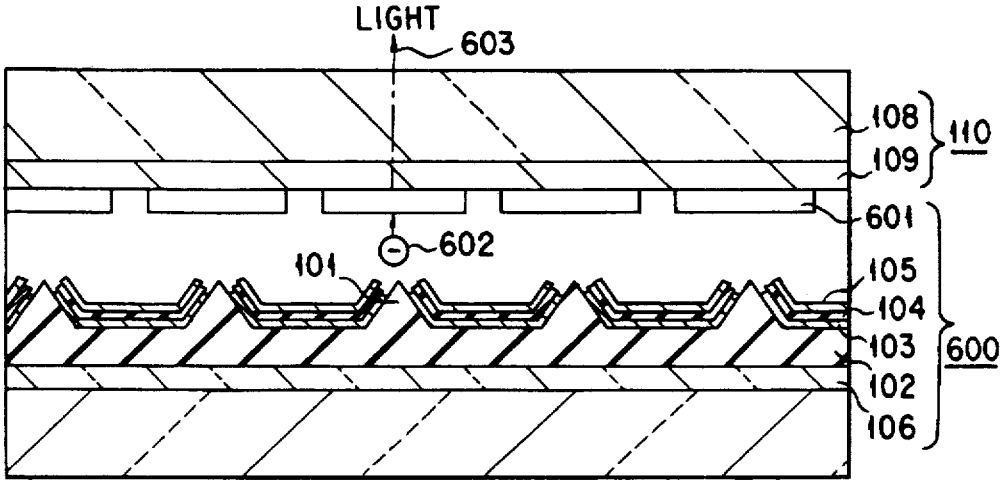
FIG. 7A is a sectional view showing a display device provided with an array of ferroelectric cold cathode shown in FIG. 2.
Figure 7B:
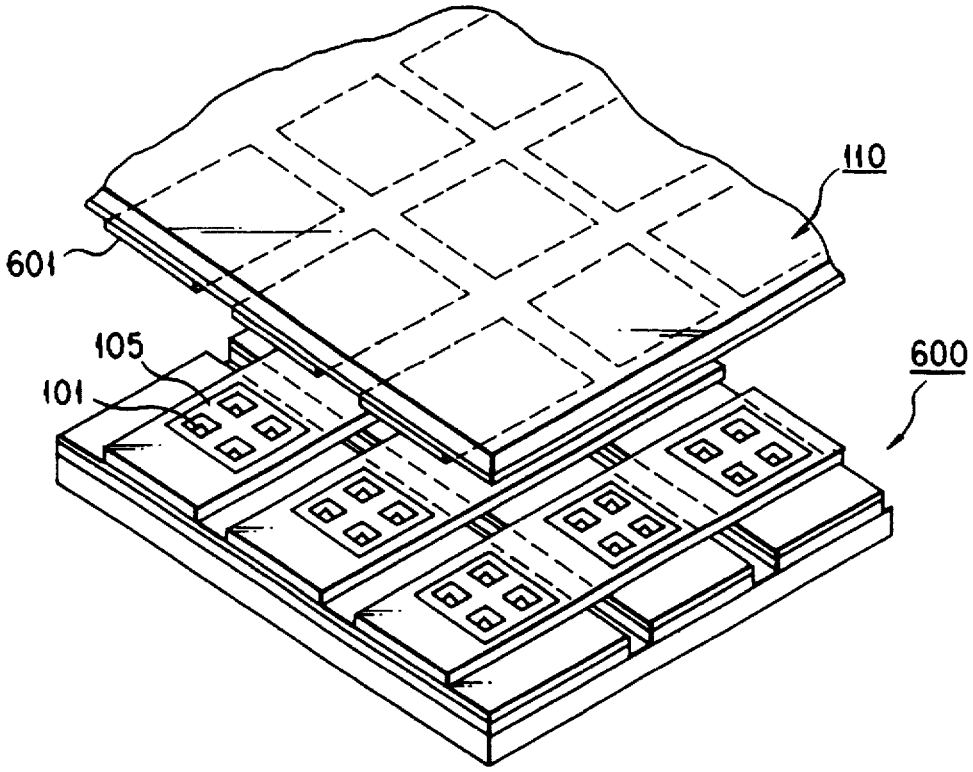
FIG. 7B is a perspective view showing the display device shown in FIG. 7A.

FIG. 7A shows a sectional view of a display device provided with an array of ferroelectric cold cathode according to the first example, while FIG. 7B shows a perspective view of this display device shown in FIG. 7A.

In the display device shown in FIGS. 7A and 7B, a plurality of the emitters 101 of the ferroelectric cold cathode of the first example are disposed at each of the pixels which have been set in array, thus constituting a ferroelectric cold cathode array substrate 600. This anode 110 comprises an anode-supporting substrate 108 and an anode 109 formed of a transparent conductive film and disposed on one surface of the anode-supporting substrate 108.

A pattern of the fluorescent layer 601 each having rectangular shape is formed on the anode 109, each of the fluorescent layer 601 being provided for each pixel so as to face the emitters 101. When electrons 602 emitted from the emitter 101 and moving toward the anode 109 are impinged on the fluorescent layer 601, a display light 603 is generated so as to exhibiting a display.

The ferroelectric cold cathode of this invention can be applied to a display device by disposing a plurality of them in a form of array for each of the pixels set in array. In this case, since it is possible, according to the ferroelectric cold cathode of this invention, to control a current of large capacity at a low driving voltage, the brightness of light for a display that can be effected with a low voltage would be greatly enhanced. Therefore, the ferroelectric cold cathode of this invention would be free from any difficulty in the operation at a low driving voltage which has been a drawback of the conventional plasma display, or a self-luminous display, so that the ferroelectric cold cathode of this invention is suited for use in a display device.

Further, since the ferroelectric cold cathode of this invention can operate at a low degree of vacuum, it has the advantage of being free from the release of gas from a fluorescent substance.

In addition to such a display device, the ferroelectric cold cathode of this invention is also suited for use as an element capable of realizing a low driving voltage and large current capacity in an electronic device such as a memory circuit element or an integrated circuit element such as a logical circuit.

In the fourth example of this invention, a plurality of the ferroelectric cold cathodes according to the first example are set in array. However, it is also possible to employ the ferroelectric cold cathodes according to the third example in the same manner as those of the first example.

Figure 8A:
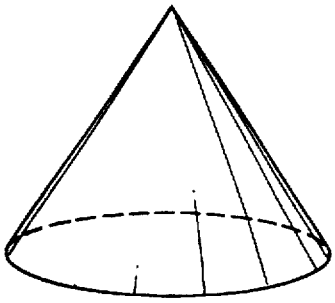
FIG. 8A is a perspective view showing an emitter of a cone shape.
Figure 8B:
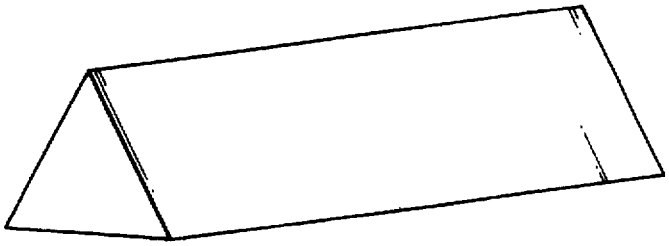
FIG. 8B is a perspective view showing an emitter of a ridge shape.

In the above examples, an emitter of pyramidal shape is employed. However, the emitter shape is not limited to the pyramidal shape, for example, the shape of the emitter may be of cone shape as shown in FIG. 8A, or of ridge-like shape as shown in FIG. 8B and others not shown here.

As explained above, it is possible according to this invention to obtain a ferroelectric cold cathode which is capable of actuating or operating at a vacuum of as low as $10^{-1}$ to $10^{-2}$ Torr and at a voltage of as low as 7 to 30V, and which can be easily manufactured and handled.

Furthermore, since an electronic device employing the ferroelectric cold cathode of this invention is capable of operating at a low degree of vacuum and hence free from the release of gas from a fluorescent substance or from the inner surface of an apparatus, and also free from any restriction regarding the selection of getter material, the electronic device is suited for use in a display device of flat panel type, a high speed driving electronic device, an electronic beam device or an environment-hard device.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A ferroelectric cold cathode comprising;

a ferroelectric layer formed of a ferroelectric material and having an emitter which is a projection having a sharp tip portion on a first surface of the ferroelectric layer;

a first electrode layer formed on said first surface of the ferroelectric layer and having an opening allowing said sharp tip portion of the emitter to be exposed therethrough; and a second electrode layer formed on a second surface of the ferroelectric layer, wherein said second surface is opposite said first surface.

2. The ferroelectric cold cathode according to claim 1, which further comprises a voltage-applying means adapted to apply a voltage between the first electrode and the second electrode thereby to reverse a dielectric polarization in the ferroelectric layer.

3. The ferroelectric cold cathode according to claim 2, wherein said voltage-applying means is a pulse voltage-applying means.

4. The ferroelectric cold cathode according to claim 1, wherein said ferroelectric material is selected from the group consisting of $PbZrO_3$—$PbTiO_3$ system material (PZT), (Pb, La)(Zr, Ti)$O_3$ system material (PLZT), $PbTiO_3$ system material, (Pb, Ca)$TiO_3$ system material, $Pb(Mg_{1/3}Nb_{2/3})O_3$—$PbZrO_3$—$PbTiO_3$ system material, $LaTiO_3$, $LiNbO_3$, and $SrTiO_3$ system material.

5. The ferroelectric cold cathode according to claim 1, wherein said sharp tip portion has a radius of curvature ranging from 0.5 to 500 nm.

6. The ferroelectric cold cathode according to claim 1, wherein said emitter is of a pyramidal, cone or ridge shape.

7. The ferroelectric cold cathode according to claim 1, which further comprises an insulating film formed between said ferroelectric layer and said first electrode layer and having an opening allowing said sharp tip portion of the emitter to be exposed therethough.

8. A ferroelectric cold cathode comprising;

a ferroelectric layer formed of a ferroelectric material and having an emitter which is a projection having a sharp tip portion on a first surface of the ferroelectric layer;

a first electrode layer formed on said first surface of the ferroelectric layer and having an opening allowing said sharp tip portion of the emitter to be exposed therethrough;

a first insulating film formed on said first electrode layer and having an opening allowing said sharp tip portion of the emitter to be exposed therethrough;

an auxiliary electrode formed on said first insulating film and having an opening allowing said sharp tip portion of the emitter to be exposed therethrough; and a second electrode layer formed on a second surface of the ferroelectric layer, wherein said second surface is opposite said first surface.

9. The ferroelectric cold cathode according to claim 8, which further comprises a voltage-applying means adapted to apply a voltage between the first electrode and the second electrode thereby to reverse a dielectric polarization in the ferroelectric layer.

10. The ferroelectric cold cathode according to claim 9, wherein said voltage-applying means is a pulse voltage-applying means.

11. The ferroelectric cold cathode according to claim 8, wherein said ferroelectric material is selected from the group consisting of $PbZrO_3$—$PbTiO_3$ system material (PZT), (Pb, La)(Zr, Ti)$O_3$ system material (PLZT), $PbTiO_3$ system material, (Pb, Ca)$TiO_3$ system material, $Pb(Mg_{1/3}Nb_{2/3})O_3$—$PbZrO_3$—$PbTiO_3$ system material, $LaTiO_3$, $LiNbO_3$, and $SrTiO_3$ system material.

12. The ferroelectric cold cathode according to claim 8, wherein said sharp tip portion has a radius of curvature ranging from 0.5 to 500 nm.

13. The ferroelectric cold cathode according to claim 8, wherein said emitter is of a pyramidal, cone or ridge shape.

14. The ferroelectric cold cathode according to claim 8, which further comprises an insulating film formed between said ferroelectric layer and said first electrode layer and having an opening allowing said sharp tip portion of the emitter to be exposed therethough.

15. An electronic device comprising a ferroelectric cold cathode and an anode disposed to face to said ferroelectric cold cathode, wherein said ferroelectric cold cathode comprises;

a ferroelectric layer formed of a ferroelectric material and having an emitter which is a projection having a sharp tip portion on a first surface of the ferroelectric layer;

a first electrode layer formed on said first surface of the ferroelectric layer and having an opening allowing said sharp tip portion of the emitter to be exposed therethrough;

a second electrode layer formed on a second surface of the ferroelectric layer wherein said second surface is opposite said first surface;

and a voltage-applying means adapted to apply a voltage between said first electrode and said second electrode thereby to reverse a dielectric polarization in said ferroelectric layer and thereby allowing electrons to be emitted from the sharp tip portion of said emitter and then to reach to said anode.

16. The electronic device according to claim 15, therein the electronic device is a display device having a fluorescent layer interposed between said ferroelectric cold cathode and said anode.

17. The electronic device according to claim 15, wherein said voltage-applying means is a pulse voltage-applying means.

18. The electronic device according to claim 15, wherein said ferroelectric material is selected from the group consisting of $PbZrO_3$—$PbTiO_3$ system material (PZT), (Pb, La)(Zr, Ti)$O_3$ system material (PLZT), $PbTiO_3$ system material, (Pb, Ca)$TiO_3$ system material, $Pb(Mg_{1/3}Nb_{2/3})O_3$—$PbZrO_3$—$PbTiO_3$ system material, $LaTiO_3$, $LiNbO_3$, and $SrTiO_3$ system material.

19. The electronic device according to claim 15, wherein said sharp tip portion has a radius of curvature ranging from 0.5 to 500 nm.

20. A method of manufacturing a ferroelectric cold cathode which comprises the steps of;

forming a depression in a substrate;

depositing a ferroelectric material over a surface of the substrate including said depression thereby forming a ferroelectric layer;

removing said substrate to expose said ferroelectric material deposited in said depression thereby to form an emitter which is a projection having a sharp tip portion on a first surface of the ferroelectric layer;

forming a first electrode layer on said first surface of said ferroelectric layer where said emitter is disposed in such a manner as to allow said sharp tip portion of the emitter to be exposed therethrough; and forming a second electrode layer on a second surface of said ferroelectric layer, wherein said second surface is opposite said first surface.

* * * * *